US007727094B2

(12) United States Patent
Sokol et al.

(10) Patent No.: US 7,727,094 B2
(45) Date of Patent: Jun. 1, 2010

(54) INSTITUTIONAL BADMINTON RACKET

(75) Inventors: Howard Sokol, Park Ridge, IL (US); Leonard H. Palmer, St. Charles, IL (US); Robert H. Salvesen, Sandwich, IL (US)

(73) Assignee: Pick-A-Paddle, Inc. IL (US)

( * ) Notice: Subject to any disclaimer, the term of this patent is extended or adjusted under 35 U.S.C. 154(b) by 336 days.

(21) Appl. No.: 12/070,980

(22) Filed: Feb. 22, 2008

(65) Prior Publication Data

US 2009/0215557 A1 Aug. 27, 2009

(51) Int. Cl.
*A63B 49/02* (2006.01)

(52) U.S. Cl. ..... 473/548; 473/524; 473/535; 473/545; 473/546

(58) Field of Classification Search ..... 473/524, 473/535, 543–546, 548; D21/729
See application file for complete search history.

(56) References Cited

U.S. PATENT DOCUMENTS

| | | | | | |
|---|---|---|---|---|---|
| 2,071,684 | A | * | 2/1937 | Dickson | 473/548 |
| 3,083,968 | A | * | 4/1963 | Yoshiaki | 473/541 |
| 4,360,202 | A | * | 11/1982 | Lo | 473/535 |
| 4,575,084 | A | * | 3/1986 | Yoneyama | 473/535 |
| 4,989,871 | A | * | 2/1991 | Sheng | 473/548 |
| 5,006,298 | A | * | 4/1991 | Tsai | 264/512 |
| 5,071,124 | A | * | 12/1991 | Davis | 473/537 |
| 5,238,247 | A | * | 8/1993 | Davis | 473/537 |
| 5,344,139 | A | * | 9/1994 | Wu | 473/535 |
| D523,106 | S | * | 6/2006 | Lin et al. | D21/753 |
| 7,211,010 | B2 | * | 5/2007 | Lin et al. | 473/546 |
| D587,324 | S | * | 2/2009 | Sokol et al. | D21/729 |
| 2007/0054761 | A1 | * | 3/2007 | Lin et al. | 473/546 |
| 2009/0215557 | A1 | * | 8/2009 | Sokol et al. | 473/524 |

FOREIGN PATENT DOCUMENTS

| | | | | |
|---|---|---|---|---|
| GB | 2026327 | A | * | 2/1980 |
| GB | 2037168 | A | * | 7/1980 |
| GB | 2076295 | A | * | 12/1981 |
| GB | 2247842 | A | * | 3/1992 |
| GB | 2282974 | A | * | 4/1995 |
| JP | 06142232 | A | * | 5/1994 |
| JP | 2003320058 | A | * | 11/2003 |
| JP | 2004065862 | A | * | 3/2004 |
| JP | 2007068971 | A | * | 3/2007 |
| JP | 2009034333 | A | * | 2/2009 |

* cited by examiner

*Primary Examiner*—Raleigh W. Chiu
(74) *Attorney, Agent, or Firm*—Wood, Phillips, Katz, Clark & Mortimer

(57) ABSTRACT

An institutional badminton racket including a head and a flexible plastic handle. The head has a metal rim around a shuttlecock striking face, and a neck rigidly secured to the rim, where the neck includes a hollow throat extending from the rim away from the striking face with lateral openings through the throat. The handle connecting end includes a first portion extending into the hollow throat, a second portion surrounding the throat, pin portions extending through the throat lateral openings and integral with the first and second portions, and a pair of wings extending generally in the plane in a lateral direction toward the head and including openings therethrough. A Y-clamp is secured around the handle connecting end and the head rim adjacent the head neck and including pins extending through the wing openings.

14 Claims, 4 Drawing Sheets

INSTITUTIONAL BADMINTON RACKET

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward badminton rackets, and particularly toward badminton rackets subject to heavy use in institutional settings.

BACKGROUND OF THE INVENTION AND TECHNICAL PROBLEMS POSED BY THE PRIOR ART

Badminton is an excellent sport at all levels, from the beginner level to highly skilled competitive matches. It is not only entertaining to play, but can be enjoyed by people of all sizes and skill levels. Moreover, it is an excellent sport for teaching hand-eye coordination in physical education classes as well as providing aerobic exercise. Advantageously, the sport requires minimal equipment (a net, rackets and a shuttlecock) and can be readily played indoors for year round enjoyment and teaching no matter what the climate.

Rackets have been made for a variety of playing levels, including expensive rackets of various materials such as metal, wood and/or composite materials for highly skilled players. However, such rackets can be relatively brittle and subject to breaking or damage if not used properly, such as if they are hit on a hard floor.

In institutional settings such as schools where the rackets can be expected to be heavily used by players of many skill levels, including particularly beginners, it is desirable to have rackets which will be extremely durable to withstand such use. Needless to say, schools are reluctant to buy equipment which can be expected to break in only few days based on the anticipated use (e.g., by young students first learning the game who can be expected to, inadvertently or not, hit the racket head on the floor from time to time). Thus, while badminton may seem like a sport requiring little equipment as already noted, to a school which would foresee having to buy many, many rackets due to breakage, this excellent sport could be viewed as prohibitively expensive to include in its curriculum.

To meet such needs, inexpensive and/or durable rackets have heretofore been manufactured for institutional uses such as schools. Generally conventional structure rackets have been made cheaply, but the result is, as would be expected, a low quality racket which, though cheaper to replace, will also still be subject to breakage requiring relatively frequent replacement. Such rackets can also tend to be poor to use, that is, to provide a poor feel when hitting the shuttlecock. Another racket which has been manufactured for institutional uses is a one piece combination handle and head made all of plastic. While that racket structure has provided some increased durability over rackets of other materials, the flexibility of the head makes it impossible to use conventional strings to generate the shuttlecock striking face and thus a different type of striking face has been required, resulting in a poor feel when using the racket. Thus, those taught in schools with such rackets could face an entirely new learning cycle when advancing to more conventional string face rackets.

The present invention is directed toward overcoming one or more of the problems set forth above.

SUMMARY OF THE INVENTION

In one aspect of the present invention, a badminton racket is provided including a head and a handle. The head has a rim around a shuttlecock striking face, and a neck rigidly secured to the rim, where neck includes a hollow throat extending from the rim away from the striking face with lateral openings through the throat. The handle includes a grip end and a connecting end, with the connecting end including a first portion extending into the hollow throat, a second portion surrounding the throat, and pin portions extending through the throat lateral openings and integral with the first and second portions. A Y-clamp is secured around the handle connecting end and the head rim adjacent the head neck.

In one form of this aspect of the present invention, the Y-clamp includes a pair of mating plastic clamp members on opposite sides of the head, with the clamp members sonic welded together.

In another form of this aspect of the present invention, the head rim and neck are metal and the handle and Y-clamp are plastic. In a further form, the handle is elastically bendable plastic and the Y-clamp is hard plastic.

In still another form of this aspect of the present invention, the handle connecting end includes a pair of wings extending generally in the plane of the striking face in a lateral direction toward the head and including openings therethrough, and the Y-clamp includes pins extending through the wing openings.

In yet form of this aspect of the present invention, the handle includes a shaft portion between the grip end and the connecting end, and the grip end includes a plugged hollow enlarged grip portion.

According to still another form of this aspect of the present invention, the head rim includes an inner surface facing the striking face and an outer surface, and the outer surface defines an indented groove around the rim.

In another aspect of the present invention, an institutional badminton racket is provided, including a head and a flexible plastic handle including a grip end and a connecting end. The head has a metal rim around a string shuttlecock striking face lying generally in a plane, and a neck rigidly secured to the rim, where the neck includes a hollow throat extending from the rim away from the striking face with lateral openings through the throat. The handle connecting end includes a first portion extending into the hollow throat, a second portion surrounding the throat, pin portions extending through the throat lateral openings and integral with the first and second portions, and a pair of wings extending generally in the plane in a lateral direction toward the head and including openings therethrough. A Y-clamp is secured around the handle connecting end and the head rim adjacent the head neck and including pins extending through the wing openings.

In one form of this aspect of the present invention, the Y-clamp includes a pair of mating hard plastic clamp members on opposite sides of the head, with the clamp members being sonic welded together around the rim and the handle clamp end.

In another form of this aspect of the present invention, the handle includes a shaft portion between the grip end and the connecting end, and the grip end includes a plugged hollow enlarged grip portion.

In still another form of this aspect of the present invention, the head rim includes an inner surface facing the striking face and an outer surface, and the outer surface defines an indented groove around the rim.

In still another aspect of the present invention, a method of making a badminton racket is provided, including the steps of (a) forming a head having (I) a metal rim around a string shuttlecock striking face lying generally in a plane and (ii) a neck rigidly secured to the rim and including a hollow throat extending from the rim away from the striking face with lateral openings through the throat, (b) molding a plastic handle to extend radially from the throat, the plastic at its head end molded by flowing the plastic into and around the hollow throat and through the lateral openings, (c) clamping two halves of a hard plastic Y-clamp together over the handle head end and the head metal rim, and (d) securing the Y-clamp halves together.

In one form of this aspect of the present invention, the securing step sonic welds the Y-clamp halves together.

In another form of this aspect of the present invention, the molding step includes molding a pair of wings extending generally in the plane in a lateral direction toward the head and including openings therethrough, and the clamping step includes extending pins between t he Y-clamp halves through the wing openings.

DETAILED DESCRIPTION OF THE INVENTION

Figure 1:
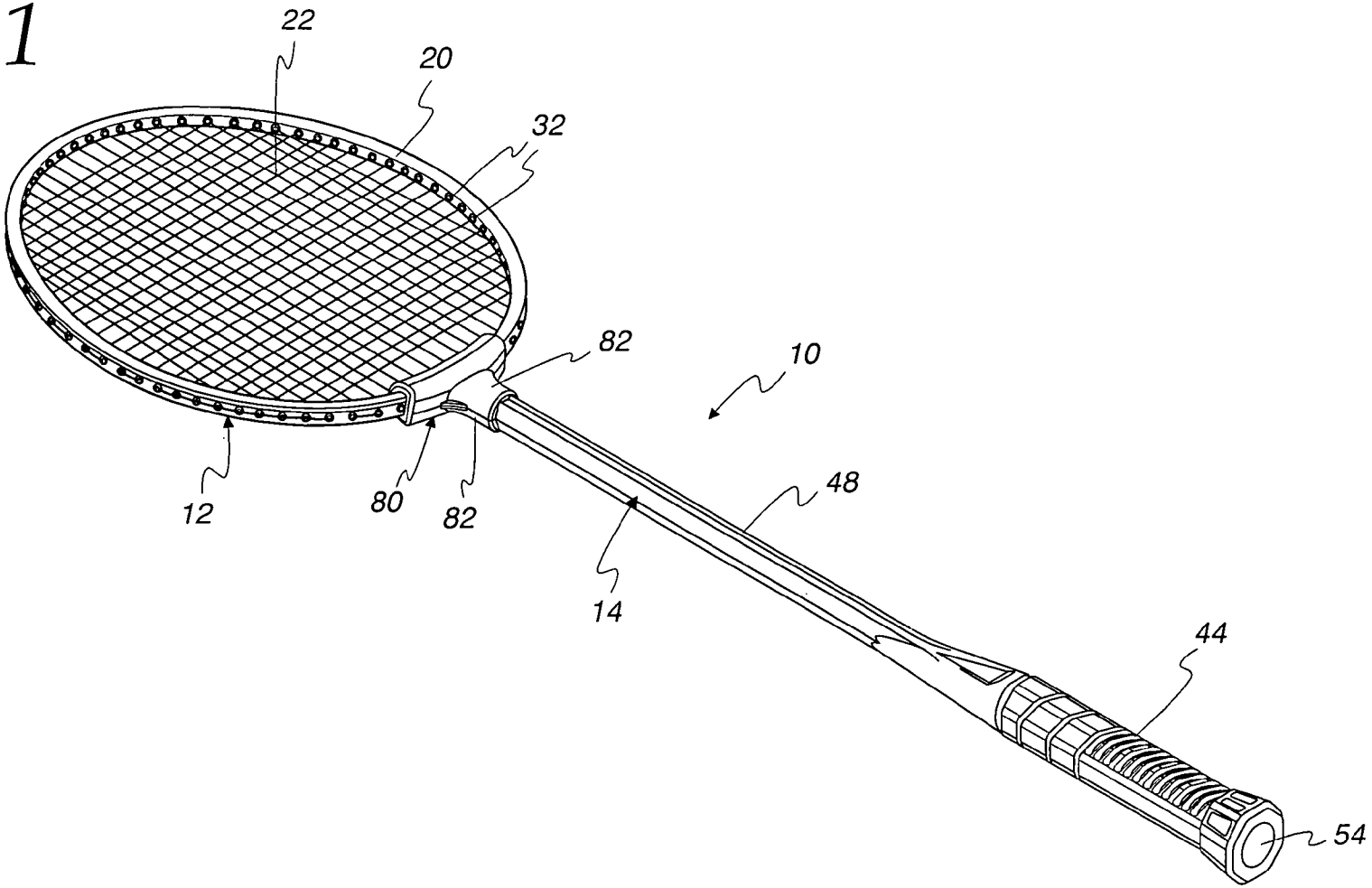
FIG. 1 is a perspective view of one embodiment of a badminton racket according to the present invention.
Figure 2:
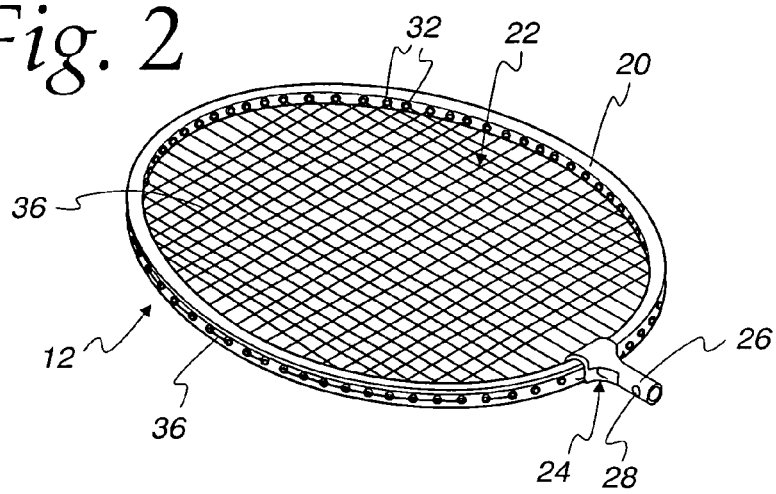
FIG. 2 is a perspective view of the head of the badminton racket of FIG. 1.
Figure 3:
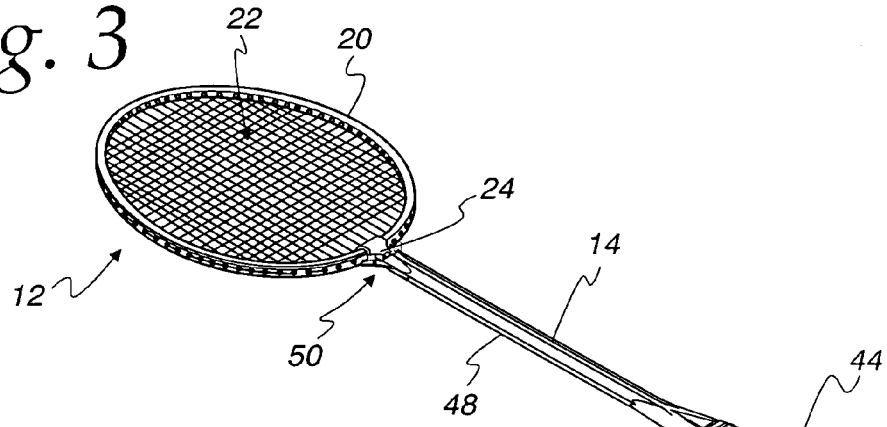
FIG. 3 is a perspective view of the head of FIG. 2 attached to a handle.

An institutional badminton racket 10 embodying the present invention is illustrated in the Figures. The racket 10 includes a head 12 and a handle 14.

The head 12 includes a rim 20 around a suitable face 22 for striking a shuttlecock (not shown) during play. The rim 20 advantageously may comprise a substantially rigid tubular metal piece bent into a generally elliptical shape, with the ends secured together by a neck 24 having a hollow throat 26 extending radially from the rim 20 (see, e.g., FIG. 7). Aligned openings or holes 28 are also provided on opposite transverse sides of the hollow throat 26 (see FIG. 7).

Holes 30 are spaced around and through the rim 20, and grommets or eyelets 32 extend through the rim 20, with suitable string 36 (such as nylon strings or, for longer life, nylon coated steel strings) being woven through the grommets 32 to form a grid defining the striking face 22 such as is known. Grommets 32a adjacent the ends of the rim 20 (see FIG. 7) also extend through the neck 24 which, together with the string 36, assists in securing the rim 20 in the desired generally elliptical shape.

The outer facing surface of the rim 20 may be advantageously concave (i.e., includes an indented groove) so that the string 36 outside the rim 20 will lie down in that recessed area. Should the rim 20 be caused to hit a surface (e.g., the floor) as can frequently occur with institutional users who may just be learning the game, the metal rim 20 itself will thus hit the surface with the softer and more easily worn string 36 being protected down in the concave area of the rim 20.

The handle 14 is molded of a suitable plastic which is substantially rigid at the grip end 44 and somewhat elastically flexible through the long, smaller diameter neck 48 extending to the end 50 connected to the racket head 12. The limited flexibility of the handle neck 48 advantageously holds the head 12 generally rigid relative to the grip end 44 so that the user may be confident in the position of the head 12 relative to their hand during play, with the elastic flexibility of the handle neck 48 both providing some power recoil during play when striking a shuttlecock and allowing shock to be absorbed to prevent damage to the racket 10 if the head 12 is struck against a surface, such as a floor as previously described.

The grip end 44 may be molded so as to be hollow, with a plug 54 added to the end of the handle 14 to close the hollow portion. Molding in this manner assists in forming the grip end 44 so that it will maintain its desired shape when the plastic cools after molding, and further advantageously reduces the weight of the racket 10 to allow the user to more easily handle the racket 10.

Figure 6:
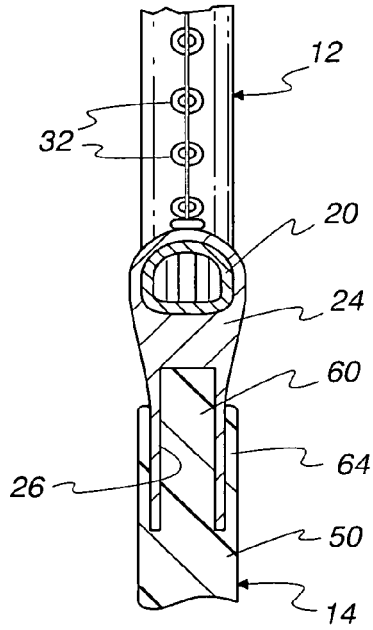
FIG. 6 is a cross-sectional view taken along line 6-6 of FIG. 5.
Figure 7:
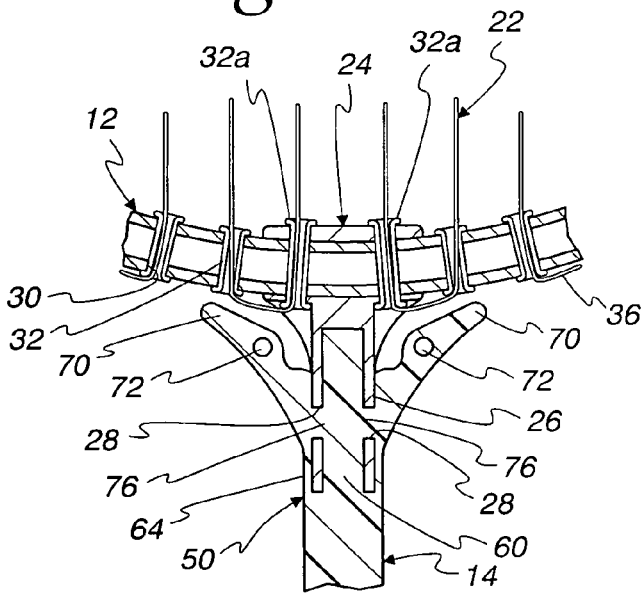
FIG. 7 is a cross-sectional view taken along line 7-7 of FIG. 5.

Advantageously according to the present invention, the connecting end 50 of the handle 14 is molded so as to cooperate with the head neck 24 as best illustrated in FIGS. 6-7. That is, the handle connecting end 50 includes a cylindrical portion 60 extending into the hollow throat 26 of the head neck 24 with a concentric substantially tubular surrounding portion 64 which surrounds the throat 26 of the head neck 24.

Two ears or wings 70 also extend laterally from the sides of the handle connecting end 50 toward the head 12. The wings 70 are substantially flat, and each include an opening 72 therethrough and further facilitate securing the plastic handle 14 to the metal head 12 as described in greater detail below.

As one point of securing the handle 14 to the head 12, suitable pin portions 76 may be provided through the transverse openings 28 in the throat 26 of the head neck 24. Most advantageously, as illustrated in FIG. 7, the handle 14 may be initially molded over (and inside) the throat 26 of the head neck 24 (with the plastic flowing into and around the throat 26 during molding). In this manner, the pin portions 76 are integral parts of the handle 14 itself, with such integral molding ensuring a tight fit of the handle connecting end 50 to the throat 26 of the head neck 24.

Figure 4:
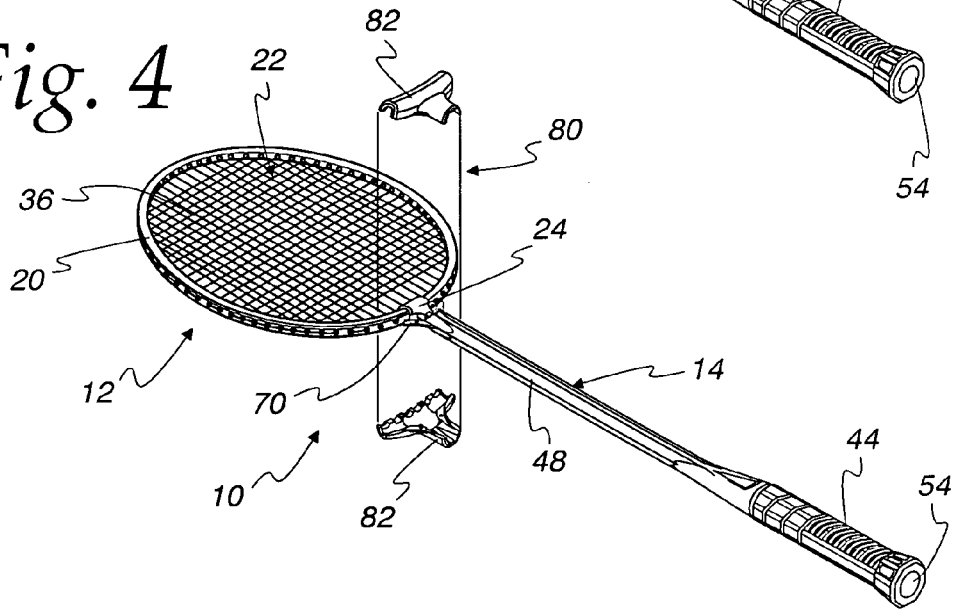
FIG. 4 is an exploded perspective view illustrating Y-clamps as added to further secure together the head and handle of FIG. 3.
Figure 5:
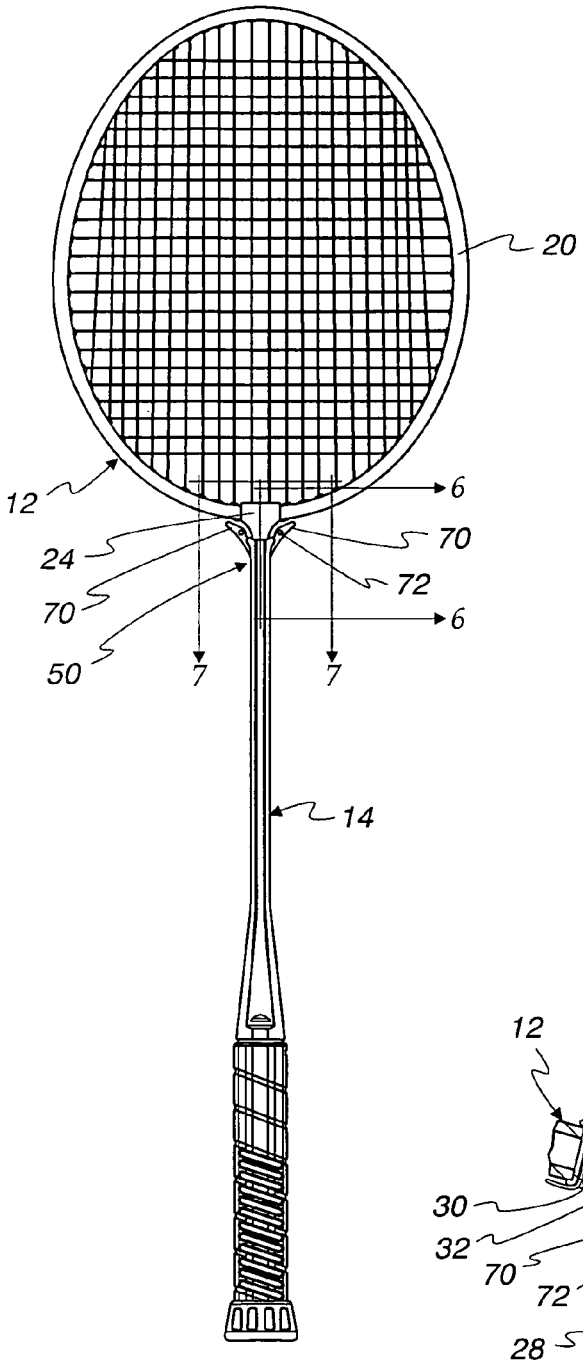
FIG. 5 is a face view of the badminton racket of FIG. 1.
Figure 8:
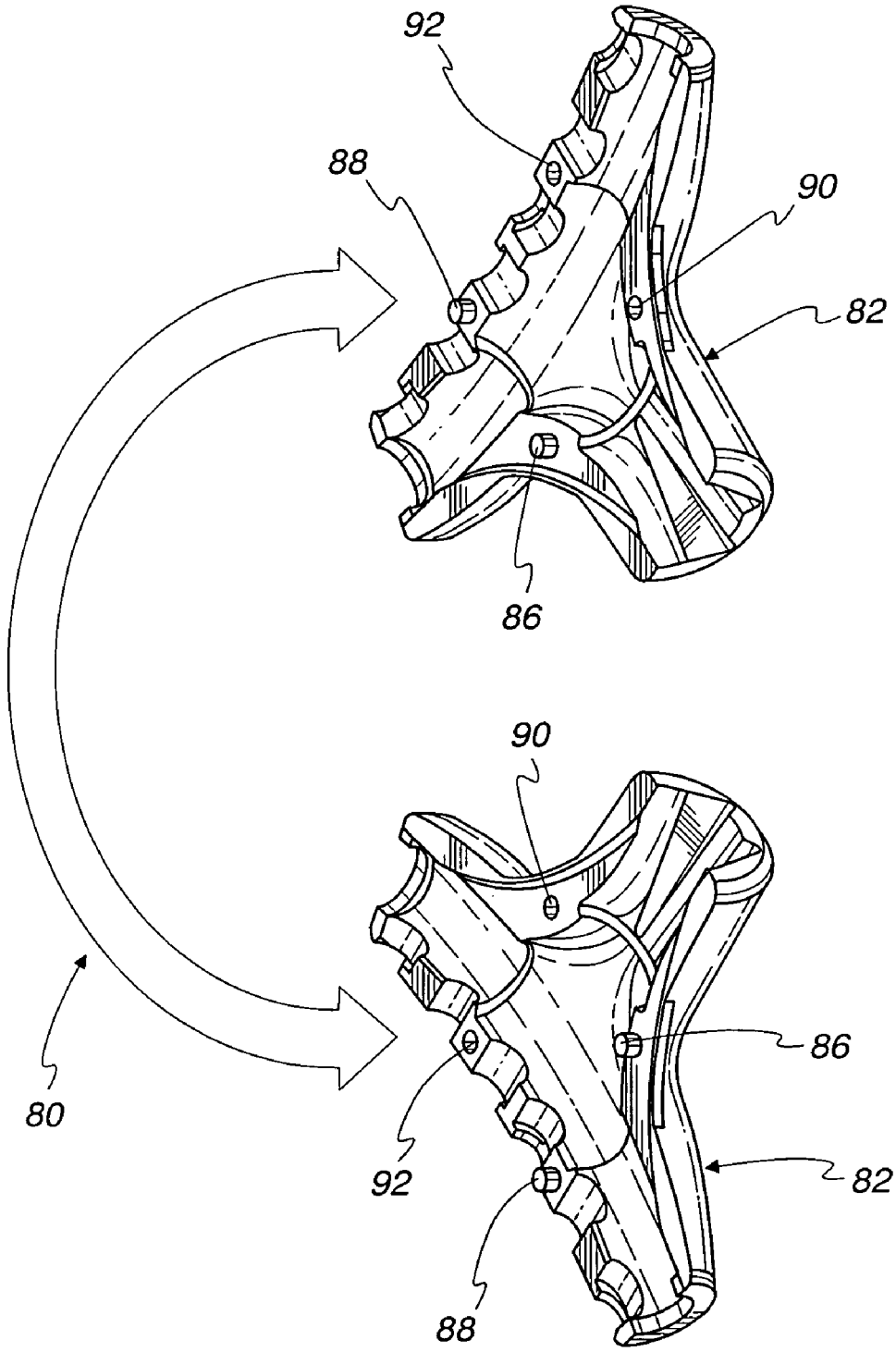
FIG. 8 is a perspective exploded view of two Y-clamp members illustrating their interconnection as used to secure the racket head to the handle.

A Y-clamp 80 is secured around the handle connecting end 50 and the head rim 20 adjacent the head neck 24. The Y-clamp 80 may advantageously consist of a pair of mating hard plastic clamp members 82 initially placed over opposite sides of the head rim 20, neck 24 and handle 14 (as shown in FIG. 4), with the two clamp members 82 then sonic welded together. Further, the clamp members 82 may be substantially identical, and include pins 86, 88 and openings 90, 92 (see FIG. 8) whereby when two clamp members 82 are clamped together on the racket 10 as illustrated, the pins 86, 88 of one clamp member 82 will be received in the openings 90, 92 of the other clamp member 82 to not only help hold the two clamp members 82 together when sonic welded but also hold the clamp members 82 in alignment. Moreover, the pin 86 on each clamp member 82 also passes through the opening 72 in a wing 70, and the wings 70 are also captured between the two clamp members 82 to thereby still further reliably secure the handle 14 so that it will not pull off the head 12.

It should thus be appreciated that a badminton racket 10 according to the present invention may be advantageously used, particularly in an institutional setting such as schools, where the racket 10 can be expected to be used frequently and to encounter more misuse and abuse than in other settings. The racket 10 has the advantage of a metal head 12 which is sufficiently stiff so that it can provide the preferred striking surface made of strings, while at the same time having the advantage of a more flexible and durable handle 14 which the plastic handle 14 can provide. Moreover, the advantages provided by making the components of different materials can be achieved while still providing a racket 10 which is reliably and securely assembled without the normal risk of such different material components coming apart.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A badminton racket, comprising:

a head having a rim around a shuttlecock striking face, and a neck rigidly secured to said rim, said neck including a hollow throat extending from said rim away from said striking face with lateral openings through said throat;

a handle including a grip end and a connecting end, said connecting end including a first portion extending into said hollow throat, a second portion surrounding said throat, and pin portions extending through said throat lateral openings and integral with said first and second portions; and a Y-clamp secured around said handle connecting end and said head rim adjacent said head neck.

2. The badminton racket of claim 1, wherein said Y-clamp comprises a pair of mating plastic clamp members on opposite sides of said head and sonic welded together.

3. The badminton racket of claim 1, wherein said head rim and neck are metal and said handle and Y-clamp are plastic.

4. The badminton racket of claim 3, wherein said handle is elastically bendable plastic and said Y-clamp is hard plastic.

5. The badminton racket of claim 1, wherein:

said striking face lies generally in a plane;

said handle connecting end further comprises a pair of wings extending generally in said plane in a lateral direction toward said head and including openings therethrough; and said Y-clamp includes pins extending through said wing openings.

6. The badminton racket of claim 1, wherein said handle includes a shaft portion between said grip end and said connecting end, and said grip end includes a plugged hollow enlarged grip portion.

7. The badminton racket of claim 1, wherein said head rim includes an inner surface facing said striking face and an outer surface, said outer surface defining an indented groove around said rim.

8. An institutional badminton racket, comprising:

a head having a metal rim around a string shuttlecock striking face lying generally in a plane, and a neck rigidly secured to said rim, said neck including a hollow throat extending from said rim away from said striking face with lateral openings through said throat;

a flexible plastic handle including a grip end and a connecting end, said connecting end including a first portion extending into said hollow throat, a second portion surrounding said throat, pin portions extending through said throat lateral openings and integral with said first and second portions, and a pair of wings extending generally in said plane in a lateral direction toward said head and including openings therethrough; and a Y-clamp secured around said handle connecting end and said head rim adjacent said head neck and including pins extending through said wing openings.

9. The institutional badminton racket of claim 8, wherein said Y-clamp comprises a pair of mating hard plastic clamp members on opposite sides of said head and sonic welded together around said rim and said handle clamp end.

10. The institutional badminton racket of claim 8, wherein said handle includes a shaft portion between said grip end and said connecting end, and said grip end includes a plugged hollow enlarged grip portion.

11. The institutional badminton racket of claim 8, wherein said head rim includes an inner surface facing said striking face and an outer surface, said outer surface defining an indented groove around said rim.

12. A method of making a badminton racket, comprising the steps of:

forming a head having a metal rim around a string shuttlecock striking face lying generally in a plane, and a neck rigidly secured to said rim, said neck including a hollow throat extending from said rim away from said striking face with lateral openings through said throat;

molding a plastic handle to extend radially from said throat, said plastic at its head end molded by flowing said plastic into and around said hollow throat and through said lateral openings;

clamping two halves of a hard plastic Y-clamp together over said handle head end and said head metal rim; and securing said Y-clamp halves together.

13. The method of claim 12, wherein said securing step comprises sonic welding said Y-clamp halves together.

14. The method of claim 12, wherein said molding step further comprises molding a pair of wings extending generally in said plane in a lateral direction toward said head and including openings therethrough; and said clamping step further comprises extending pins between said Y-clamp halves through said wing openings.

* * * * *